US007392041B2

(12) United States Patent
Brush et al.

(10) Patent No.: US 7,392,041 B2
(45) Date of Patent: Jun. 24, 2008

(54) MOBILE ACCESS TO INFORMATION USING IMAGES

(75) Inventors: Alice Jane Bernheim Brush, Bellevue, WA (US); Carman G. Neustaedter, Calgary (CA)

(73) Assignee: Microsoft Corporation, Redmond, CA (US)

( * ) Notice: Subject to any disclaimer, the term of this patent is extended or adjusted under 35 U.S.C. 154(b) by 81 days.

(21) Appl. No.: 11/359,856

(22) Filed: Feb. 22, 2006

(65) Prior Publication Data

US 2007/0159927 A1 Jul. 12, 2007

Related U.S. Application Data

(60) Provisional application No. 60/756,914, filed on Jan. 6, 2006.

(51) Int. Cl.
*H04M 1/64* (2006.01)

(52) U.S. Cl. ..... 455/414.1; 455/418; 368/23; 368/29; 368/30

(58) Field of Classification Search ..... 455/414.1, 455/418, 419, 566; 368/23, 29, 30
See application file for complete search history.

(56) References Cited

U.S. PATENT DOCUMENTS

| | | | | |
|---|---|---|---|---|
| 6,417,797 | B1 * | 7/2002 | Cousins et al. | 342/179 |
| 6,965,828 | B2 * | 11/2005 | Pollard | 701/213 |
| 2002/0044158 | A1 * | 4/2002 | Peyser et al. | 345/700 |
| 2002/0113757 | A1 * | 8/2002 | Hoisko | 345/8 |
| 2003/0014160 | A1 * | 1/2003 | Nordquist et al. | 700/275 |
| 2004/0010367 | A1 * | 1/2004 | Pollard | 701/211 |
| 2005/0114459 | A1 * | 5/2005 | Tu et al. | 709/207 |
| 2005/0289216 | A1 * | 12/2005 | Myka et al. | 709/201 |
| 2006/0003783 | A1 * | 1/2006 | Fukui et al. | 455/517 |
| 2006/0148528 | A1 * | 7/2006 | Jung et al. | 455/566 |
| 2006/0193448 | A1 * | 8/2006 | Donoghue et al. | 379/67.1 |
| 2006/0199611 | A1 * | 9/2006 | Eskelinen | 455/556.2 |
| 2006/0270461 | A1 * | 11/2006 | Won et al. | 455/566 |

OTHER PUBLICATIONS

Beech, et al. "The Lifestyles of Working Parents" (2004) Report HPL-2003-88R1, HP Labs, 114 pages.
Brush, et al. "A Survey of Personal and Hosehold Scheduling" (2005) pp. 330-331.
Crabtree, et al. "Finding a Place UbiComp in the House" (2003) Proc Ubicomp, pp. 208-226.
Crabtree, et al. "Informing the Development of Calendar Systems for Domestic Use" (2003) Proc ECSCW, 21 pages.
Dourish. "Where the Action is: The Foundation of Embodied Interaction" (2001) MIT Press, 4 pages.

(Continued)

*Primary Examiner*—Gary F. Paumen
(74) *Attorney, Agent, or Firm*—Amin, Turocy & Calvin, LLP

(57) ABSTRACT

The subject application relates to a system(s), methodology, and user interface that facilitate improving mobile awareness of information, activities, events, and occasions by way of images. The application involves providing images of a desired application such as a calendar for example on a mobile device display. As a result, the visual integrity of the application (e.g., calendar) can be preserved and the appropriate information can be more accurately conveyed to the user. The images can be navigated about and data can be entered into the application as desired to modify the content of the image.

17 Claims, 10 Drawing Sheets

OTHER PUBLICATIONS

Edwards, et al. "At Home with Ubiquitous Computing: Seven Challenges" (2001), pp. 256-272.
Elliot, et al. "Time, Ownership and Awareness: The Value of Contextual Locations in the Home" (2005) Proc Ubicomp, 18 pages.
Family Scheduler Members Login http://www.familyscheduleronline.com/ last viewed Mar. 16, 2006, 1 page.
Hutchinson, et al. "Family Calendar Survey" (2002) Report CS-TR-4412 Department of Computer Science, university of Maryland, 3 pages.
Our Family Wizard http://www.ourfamilywizard.com/index.cfm last viewed Mar. 16, 2006.
Neustaedter, et al. "Where Are You and When Are You Coming Home? Foundations of Interpersonal Awareness" (2005) GroupLab Working Paper, 11 pages.
Norman. "The Invisible Computer" (1998) Cambridge, MAMIT Press, pp. 51-68.
Palen. "Social, Individual & Technological Issues for Groupware Calendar Systems" (1999) Proc CHI, ACM Press, pp. 17-24.
Plaisant, et al. "Shared Family Calendars: Promoting Symmetry and Accessibility" (2003) Report HCIL-2003-38, Department of Computer Science, University of Maryland, 33 pages.
Sellen, et al. "The Everyday Problems of Working Parents: Implications for New Technologies" (2004) Report HPL-2004-37, HP Labs, 6 pages.
Tam, et al. "A Framework for Asynchronous Change Awareness in Collaboratively-Constructed Documents" International Journal of Human Computer Studies, pp. 67-83.
Taylor, et al. "Artful Systems in the Home" (2005) Proc CHI, ACM Press, pp. 641-650.
Yang, et al. "Experimental Analysis of Mode Switching Techniques in Pea-based User Interfaces" (2005) CHI 2005, ACM Press, pp. 461-470.

* cited by examiner

MOBILE ACCESS TO INFORMATION USING IMAGES

CROSS REFERENCE TO RELATED APPLICATION

This application claims the benefit of U.S. Provisional Application Ser. No. 60/756,914, entitled MOBILE ACCESS TO INFORMATION USING IMAGES and filed on Jan. 6, 2006, the entirety of which is incorporated herein by reference.

BACKGROUND

Everyday family life involves a myriad of mundane activities: for example, recurring soccer games, piano lessons, doctors' appointments, work schedules, relatives' visits, family outings, softball practices, after-school activities, and much more. These events must all be scheduled and coordinated between family members and then re-scheduled if things do not go as planned or conflicts arise. As a result, family life often requires a complex routine for awareness and coordination to manage the everyday activities that constitute work, personal, and familial aspects of life. This notion of family coordination extends beyond the home to also encompass activities while on-the-go or at work. For example, it involves scheduling appointments while at the doctor's office or checking the family calendar at work for evening events.

Despite families using various organization schemes, coordination among family members still remains an everyday problem for many people. Paper calendars are one tool used by families to help stay organized: they are easy to use, personalizable, and create an instant archive of family activities. Yet the downside is paper calendars are not available outside the home or available to more than one family member at a time when one member is at home and one member is away from the home. Thus, sharing paper calendars between multiple family members can be challenging if not impossible most of the time since there is typically only one copy of the paper calendar. Families are limited to keeping the paper calendar centrally located such as in the home which restricts access to it when away from the home.

Many families have turned to conventional electronic calendars as a possible remedy. However, these often take time to open (e.g., computer boot-up time) and may be inconveniently located in one room of the home. Access to these electronic calendars can be difficult too since they may not be readily available once outside the home. Overall, either electronic or paper calendars can be hard to synchronize when multiple calendars are used.

SUMMARY

The following presents a simplified summary in order to provide a basic understanding of some aspects of the systems and/or methods discussed herein. This summary is not an extensive overview of the systems and/or methods discussed herein. It is not intended to identify key/critical elements or to delineate the scope of such systems and/or methods. Its sole purpose is to present some concepts in a simplified form as a prelude to the more detailed description that is presented later.

Access to information on mobile devices such as mobile phones suffers from the fact that there is little space to present the information. For example, when displaying a month view of a calendar, conventional computer calendars represent the amount of information on any particular day using filled shapes that are difficult to understand. Some other application systems have tried to use zooming to expand the viewing space; however, the majority of events are still shown using symbols. Thus, traditional applications leave the calendar a challenge to comprehend.

The subject application relates to a system(s), methodology, and user interface that facilitate improving mobile awareness of information activities, events, and occasions by way of images. Unlike conventional paper or computer calendars which are not easily shared among many disparately located users at about the same time, the subject application provides a digital calendar system that can be readily maintained via one or more base devices. Images of the calendar information such as an image of one or more months can be communicated to one or more mobile devices to facilitate improving activity awareness for the respective users.

Using the keypad or other navigation components available on the mobile device, the view of the calendar can be adjusted and manipulated such as by zooming, panning, and scrolling. Furthermore, when viewing the calendar images, certain numbered keys or navigation control keys on the device can be specifically programmed to perform desired operations including zoom in, zoom out, pan left, pan right, scroll up, scroll down, refresh, day view, today view, week view, and/or month view.

Using and viewing images of the calendar maintains the overall integrity of the information contained therein so that users can quickly ascertain their activity schedule or their availability at a glance—without having to decipher symbols, acronyms, or odd abbreviations that correspond to their information. Despite the substantially smaller size of mobile device screens compared to the standard computer monitor, relevant and useful information can still be obtained from an image of the calendar. This is because the calendar grid has a strong spatial layout compared to other types of information or data, which may suggest that the readability of calendar content tends to be less important to users than the presence of calendar items—at least in some cases. For example, planning some events like week or day long seminars or vacations requires a "completely" free week or day for the particular user. Thus, seeing items on any particular day or week without actually identifying what they are may be enough information to let the user know that he/she cannot schedule the seminar or vacation for that day or for that week. In other cases, such as trying to fit in an hour long meeting, viewing a day's activities may be more useful to allot for commute times, traffic considerations, and the like. Moreover, coordination of schedules or events while on-the-go (away from the base device) can be optimized by visualizing the actual calendar items and/or their content rather than just viewing a myriad of symbols offered by traditional systems.

The digital calendar system employed herein can be maintained from one or more base devices that permits input via inking, typing, pointing, or voice mechanisms. The user interface for the subject digital calendar offers multiple views such as month, week, and day views. Furthermore, the calendar system and user interface can be customized and/or personalized depending on user preferences. For example, different backgrounds can be selected such a one per month; and color can be employed to denote particular events, activities, subject, or user. Additional features include resizable items, highlighting or otherwise visually enhancing more noteworthy items, and reminders sent from the calendar to other remote devices such as a PDA, cellular phone, or smart phone via text messaging or email. Security procedures for access may be minimal or non-existent to optimize use and accessibility of the calendar system to all relevant users. Given this level of unrestricted access, additions, changes, or deletions to the calendar can be tracked and/or readily undone if needed so that items are not inadvertently or intentionally changed without the knowledge of others.

Any calendar data can be stored on the local device or communicated to a remote server such as a web-based server. Other portable or non-portable devices can access the server to view, add, or edit previously scheduled items from a remote location (e.g., in the car or at work). Any changes made on one device (e.g., at work or from home den) can be uploaded to update the calendar on the other devices (e.g., in home at kitchen). Mobile devices such as mobile phones, PDAs, or smart phones can retrieve images of the calendar for quick viewing. Alternatively, information can be entered on the calendar via the mobile device, stored, and then later retrieved by the base device(s). Thus, family users can readily coordinate their individual schedules and gain improved awareness of the overall family schedule while maintaining essentially one digital calendar.

To the accomplishment of the foregoing and related ends, certain illustrative aspects of the invention are described herein in connection with the following description and the annexed drawings. These aspects are indicative, however, of but a few of the various ways in which the principles of the invention may be employed and the subject invention is intended to include all such aspects and their equivalents. Other advantages and novel features of the invention may become apparent from the following detailed description of the invention when considered in conjunction with the drawings.

DETAILED DESCRIPTION

Figure 1:
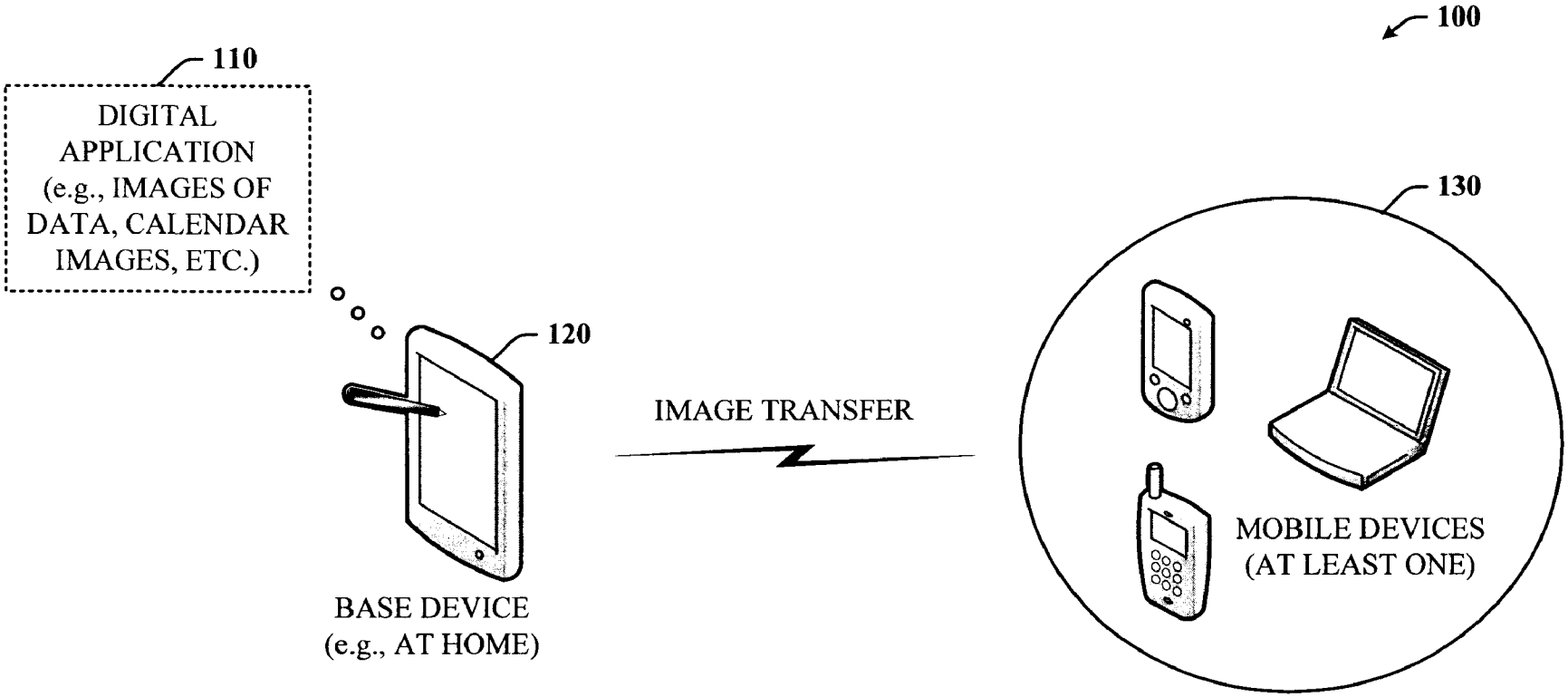
FIG. 1 is a block diagram that demonstrates mobile access to information using images from a digital calendar system maintained on a base device (by way of a server/data store).

The subject systems and/or methods are now described with reference to the drawings, wherein like reference numerals are used to refer to like elements throughout. In the following description, for purposes of explanation, numerous specific details are set forth in order to provide a thorough understanding of the systems and/or methods. It may be evident, however, that the subject systems and/or methods may be practiced without these specific details. In other instances, well-known structures and devices are shown in block diagram form in order to facilitate describing them.

As used herein, the terms "component" and "system" are intended to refer to a computer-related entity, either hardware, a combination of hardware and software, software, or software in execution. For example, a component may be, but is not limited to being, a process running on a processor, a processor, an object, an executable, a thread of execution, a program, and a computer. By way of illustration, both an application running on a server and the server can be a component. One or more components may reside within a process and/or thread of execution and a component may be localized on one computer and/or distributed between two or more computers.

The subject systems and/or methods can incorporate various inference schemes and/or techniques in connection with the placement or appearance of calendar items based on user input or user behavior. For example, a digital calendar system can learn that items associated with a person's name or with event names or subjects should be displayed in a visually different manner from other calendar items particularly to optimize visibility on a mobile device. Imagine that a user routinely makes items including the name "Colin" appear green while items for "Mike" are typically written in red. To save the user time, the digital calendar system can make use of one or more various inference schemes to learn this behavior and then perform it automatically the next time an entry for Colin or Mike is made by the user (or any other user). By doing so, consistent visual cues or patterns can be maintained despite entry of calendar items by different household members or users. Thus, the digital calendar system can recognize the underlying operating device (e.g., mobile device or desktop) and automatically adjust various viewability features to optimize the visibility of the items according to the current display space/screen.

As used herein, the term "inference" refers generally to the process of reasoning about or inferring states of the system, environment, and/or user from a set of observations as captured via events and/or data. Inference can be employed to identify a specific context or action, or can generate a probability distribution over states, for example. The inference can be probabilistic—that is, the computation of a probability distribution over states of interest based on a consideration of data and events. Inference can also refer to techniques employed for composing higher-level events from a set of events and/or data. Such inference results in the construction of new events or actions from a set of observed events and/or stored event data, whether or not the events are correlated in close temporal proximity, and whether the events and data come from one or several event and data sources.

Families must continually organize, plan, and stay aware of the activities of their households in order to coordinate everyday life. The problem is that despite having organization schemes, many people still feel overwhelmed when it comes to family coordination. To overcome the many limitations or restrictions with paper calendars and conventional electronic calendars, an inkable digital calendar system designed for multiple users that can be easily updated to mitigate the need to maintain many disparate calendars is provided herein. In most instances, coordination is not typically done through the family calendar; rather, the family calendar is a tool that can provide family members with an awareness of activities and schedule changes that in turn enables coordination. Thus, the subject digital calendar system discussed herein includes tools that enable families to use their own coordination routines without the severe restrictions of existing paper calendars and traditional Web or electronic calendars.

Furthermore, users can access their calendar when mobile and view their calendar information using images of the actual calendar. By doing so, the users maintain a clear understanding of their activities and an awareness of their availability while on-the-go and away from their full-size calendar. Other types of information can be retrieved on the mobile device as well and viewed using images. However, for the ease of discussion, the subject application will be described with respect to calendar information.

Referring now to FIG. 1, there is a block diagram 100 that demonstrates mobile access to information using images from a digital application 110 such as a calendar system maintained on one or more base devices 120. In particular, images can be generated from the calendar system such as the month view of the calendar. Using web-based services or network servers, such images can be communicated or transferred to one or more mobile devices 130 to facilitate mobile access of the information. Examples of such mobile devices 130 include but are not limited to smart phone, cell phone, laptop, and PDA. Images can be refreshed or uploaded to the mobile device when desired. Because the display space is much smaller on the mobile device than a full-size computer monitor, the images may be resized for optimal viewing on the smaller screens. Unlike traditional systems which often alter or convert calendar data for viewing on the mobile device display, the subject application retains the integrity of the information format and spatial layout of the calendar. Thus, confusion can be mitigated when viewing the calendar on mobile devices.

Figure 4:
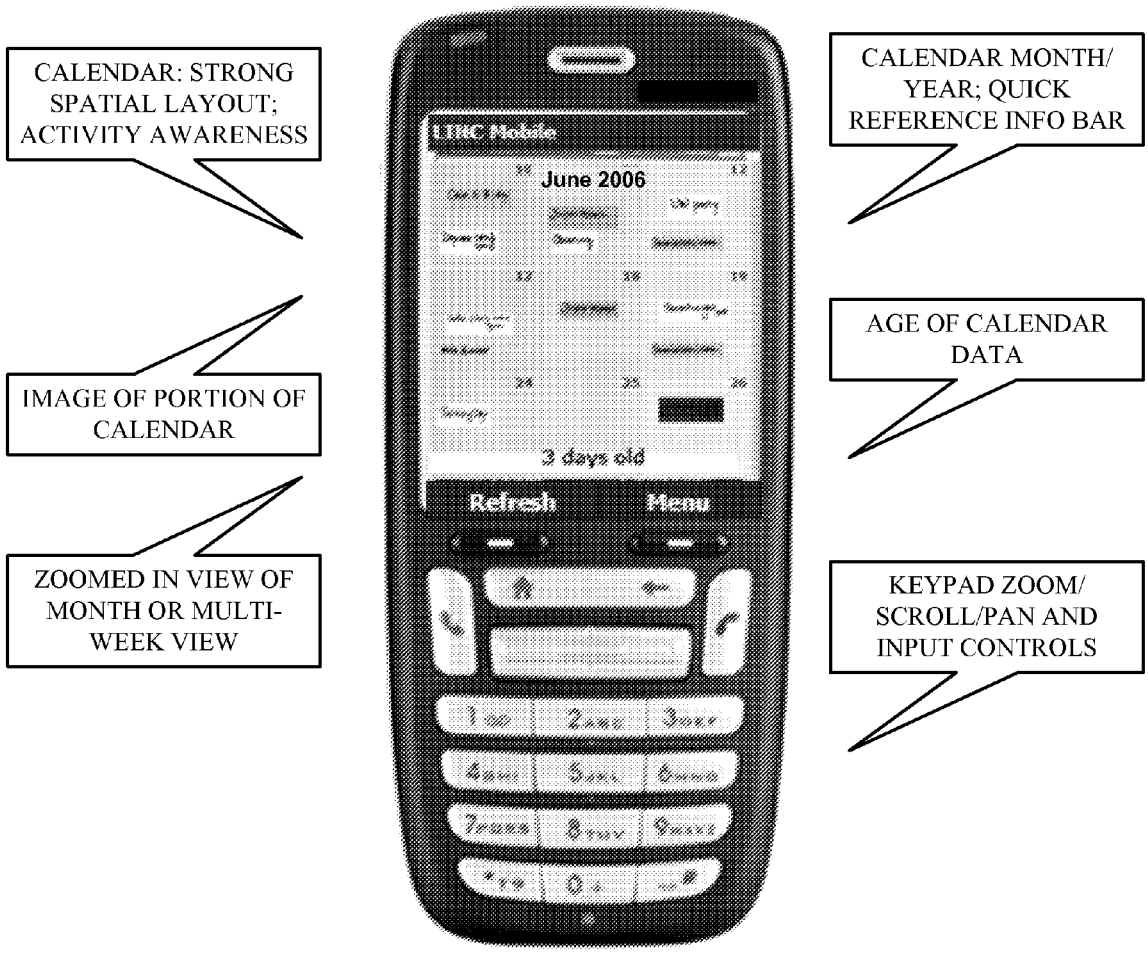
FIG. 4 is an exemplary user interface displaying a digital calendar image on a mobile device.

In practice for instance, imagine the following scenario in conjunction with FIG. 4, infra. Pamela is a busy mother of two. Today she is at the dentist's office with her son William and needs to schedule another dental cleaning appointment for him in 6 months. She pulls out her smart phone and opens her calendar. The calendar application presents a screen showing an image of her calendar for this month. The image of her calendar appearing on her smart phone is substantially the same view of the calendar that she is accustomed to interacting with on her home or office computer. Pamela is interested in activities or conflicts in about 6 months so she uses a navigation control (e.g., rocker switch) to quickly go to June 2006. The user interface or display on her smart phone reads "3 days old" which means that it has been 3 days since she retrieved the calendar information; so she refreshes the calendar using a "refresh" softkey to obtain the latest version of the calendar. The screen refreshes and shows Pamela a zoomed out image of June 2006. William still has school the first two weeks of June so she asks the receptionist if the dentist has any available appointments on the $19^{th}$. The dentist is on vacation on the $19^{th}$ but is available the week of the $26^{th}$. Pamela looks at that week and notices that there are a few things already on the calendar for that week. To see that week in more detail, she zooms in. If the whole week is not visible at once, she can pan across the week to see the whole week. William is attending summer day camp but there's only a half day of camp on the $28^{th}$ (not shown) and the dentist is available on the $28^{th}$. Pamela can enter the appointment using the keypad on her smart phone and then upload the new information onto the base device but she prefers to ink in the appointment on the base device.

Figure 2:
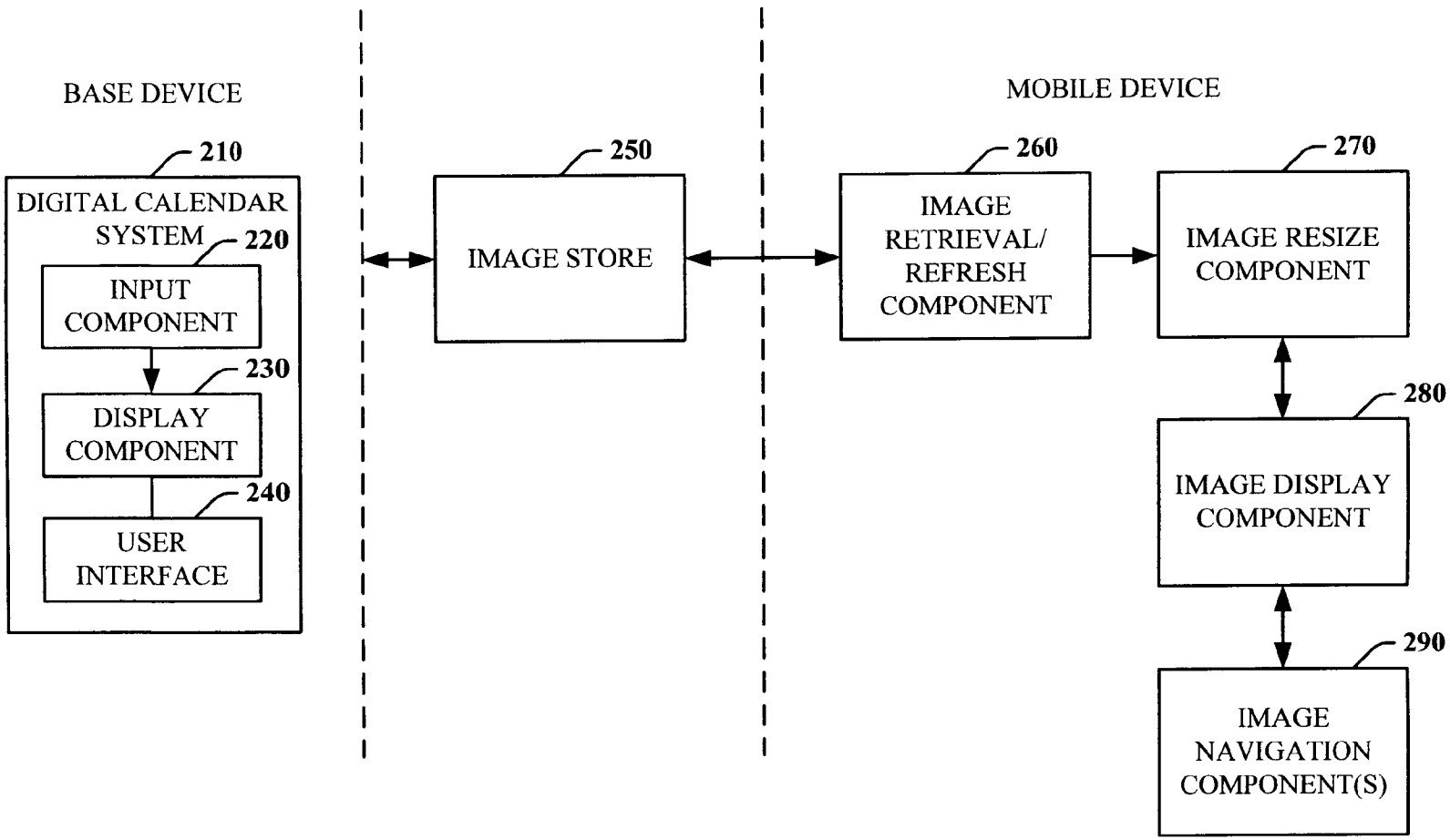
FIG. 2 is a block diagram that demonstrates mobile access of a digital calendar system via images that facilitates awareness and coordination of activities.

Referring now to FIG. 2, there is a block diagram 200 that demonstrates mobile access of a digital calendar system 210 using images that facilitates awareness and coordination of activities. In particular, the digital calendar can be primarily maintained on one or more base devices where input via inking, typing, or other mechanisms (220) can be readily entered into the calendar system 210. A display component 230 can present the calendar information to one or more users using a user interface 240 that promotes quick and efficient viewing or entering of information on the calendar. The calendar data can be stored in various formats including images. The images can be saved to an image store 250, for instance, which may be accessible by one or more mobile or non-mobile devices via an Internet or Intranet or other wired or wireless connection.

When viewing the calendar on the mobile device is desired, an image retrieval component 260 can upload an image of the last retrieved calendar or the most current calendar depending on the operation invoked by the user. Before the image is displayed, an image resize component 270 can adjust the dimensions of the image for a proper fit to the mobile device screen. The image display component 280 presents the image of the calendar to the user. Various navigation controls 290 can be employed to view the image. For example, the image can be zoomed in or out, panned in any direction and/or scrolled right and left or up and down. Information in the image can also be modified or new information can be added using one or more input components such as the keypad on the device.

Figure 3:
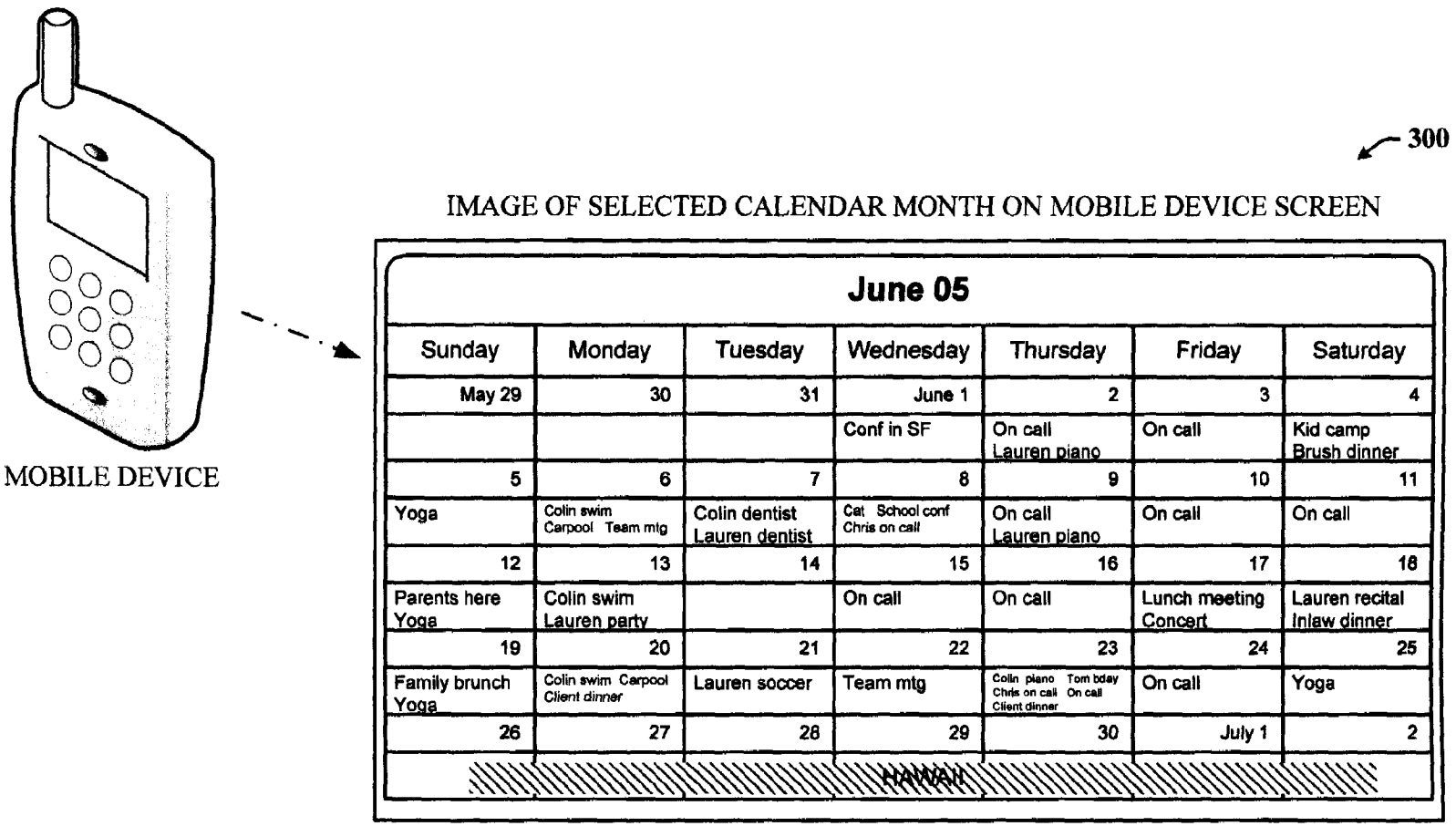
FIG. 3 illustrates a mobile device screen display showing an exemplary calendar image retrieved, for example, from a base device or server.

Turning now to FIG. 3, a mobile device screen display 300 is illustrated that shows an exemplary calendar image retrieved, for example, from a base device or server (not shown). The exemplary calendar image is of June 2005. As can be seen, the calendar data is visible and the user can readily reference the image to determine availability for proposed events or to determine which days are lighter than others. The full view of the month can be shown at once on the display or the month view can be enlarged to show more detail. When enlarged, portions of the month may be visible at once.

In FIG. 4, there is an exemplary user interface displaying a digital calendar image on a mobile device 400. The calendar has a strong spatial layout, thus even a partial view of an image of the calendar month still provides valuable information to the user. The user interface for viewing the calendar image can include an information bar for quick reference of the current view or the month or week on display. The age of the calendar data on display can also be presented on the user interface. The keypad or other navigation buttons on the device can be employed to navigate through the image, to refresh the image, or to input new information.

Figure 5:
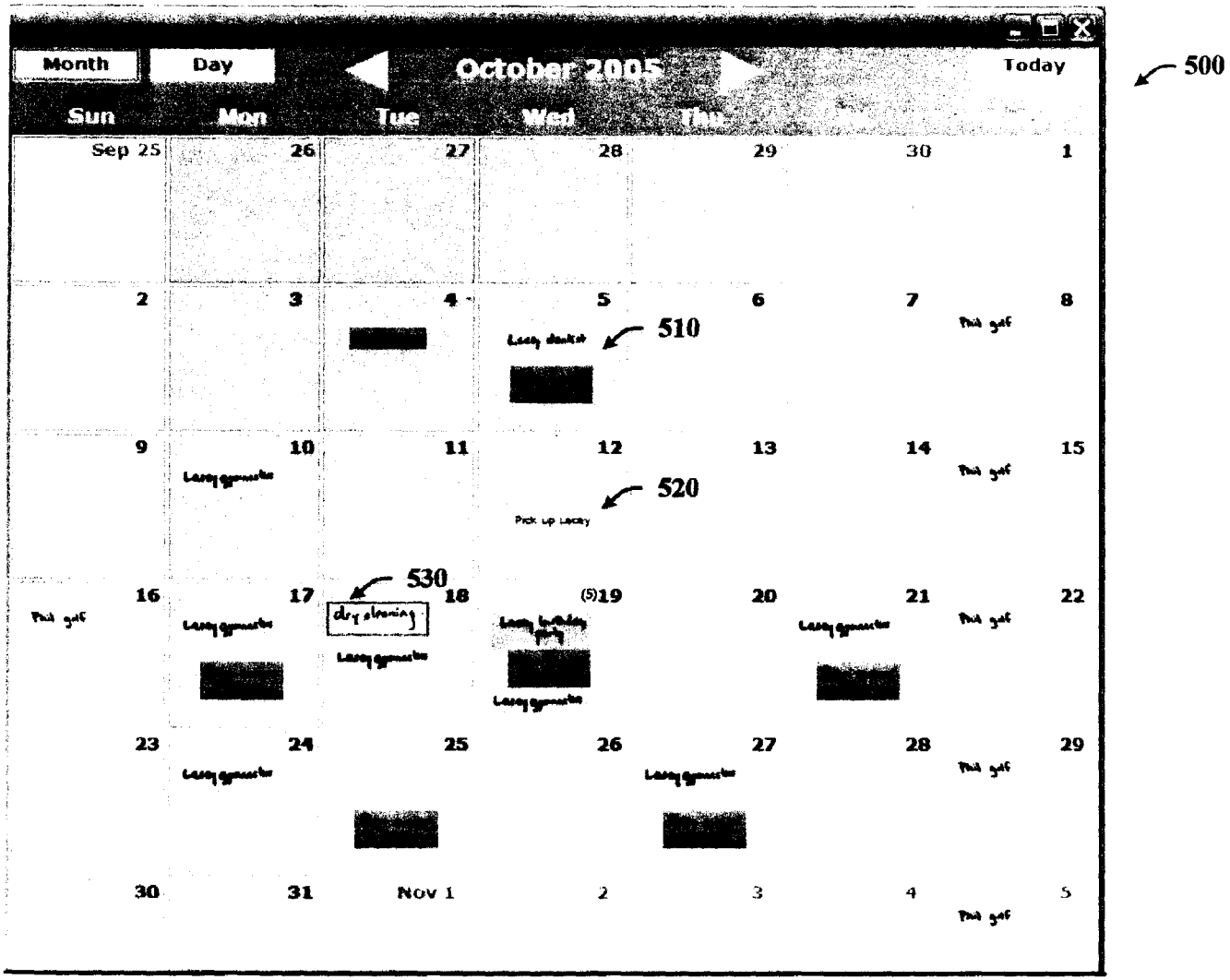
FIG. 5 is an exemplary user interface displaying a digital calendar image in month view as can be displayed on a mobile device.

Referring now to FIG. 5, there is an exemplary user interface displaying a digital calendar image 500 in month view as can be displayed on a mobile device. As can be seen, there are a plurality of calendar items in both inked format 510 and typed format 520. Items which have been modified can be visually enhanced (530) to make it readily apparent to the user that an item has changed (in terms of date or time, for example). Examples of such enhancements include highlighting or flashing the item.

Figure 6:
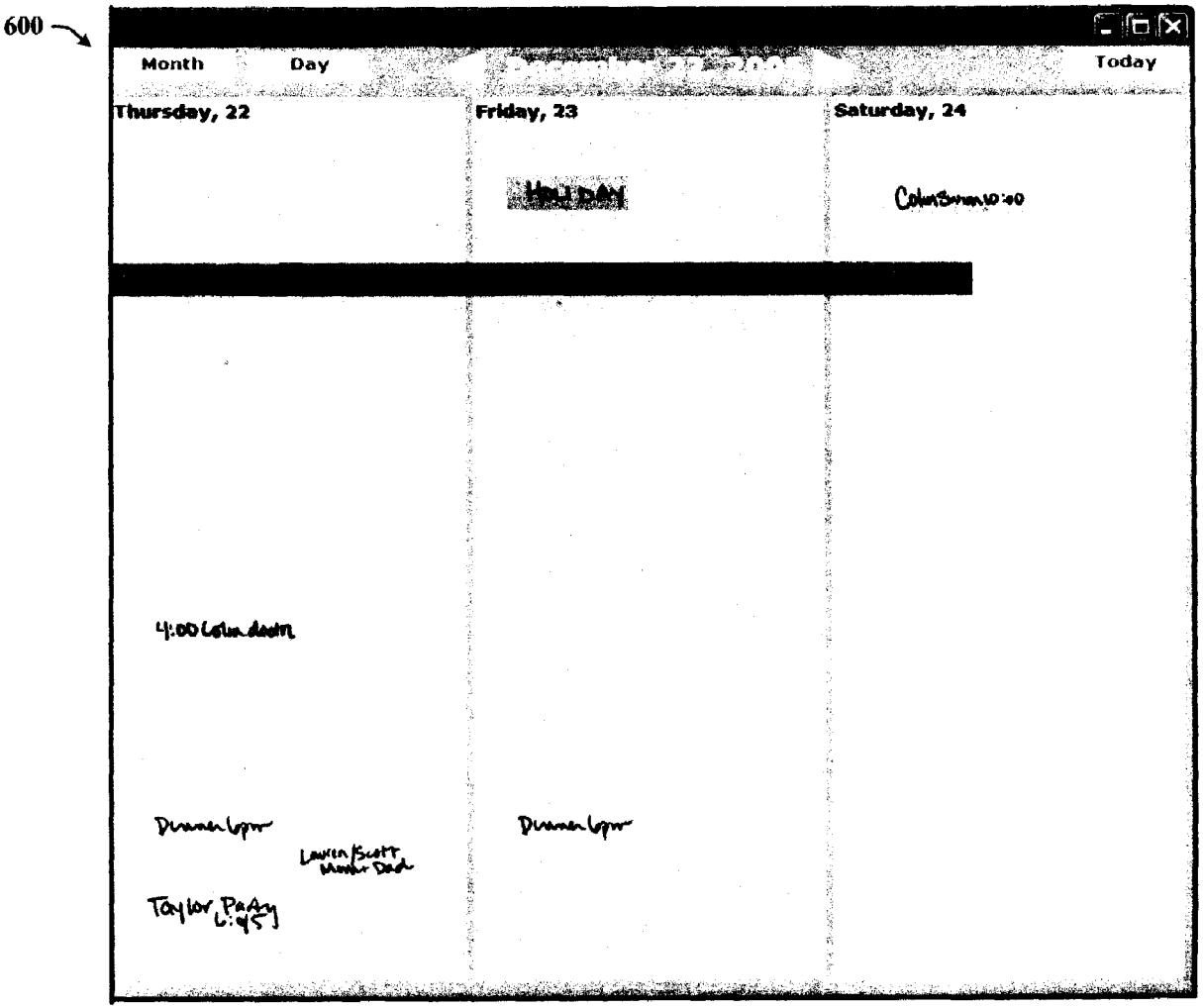
FIG. 6 is an exemplary user interface displaying a digital calendar image in day view where items are organized according to time buckets.
Figure 7:
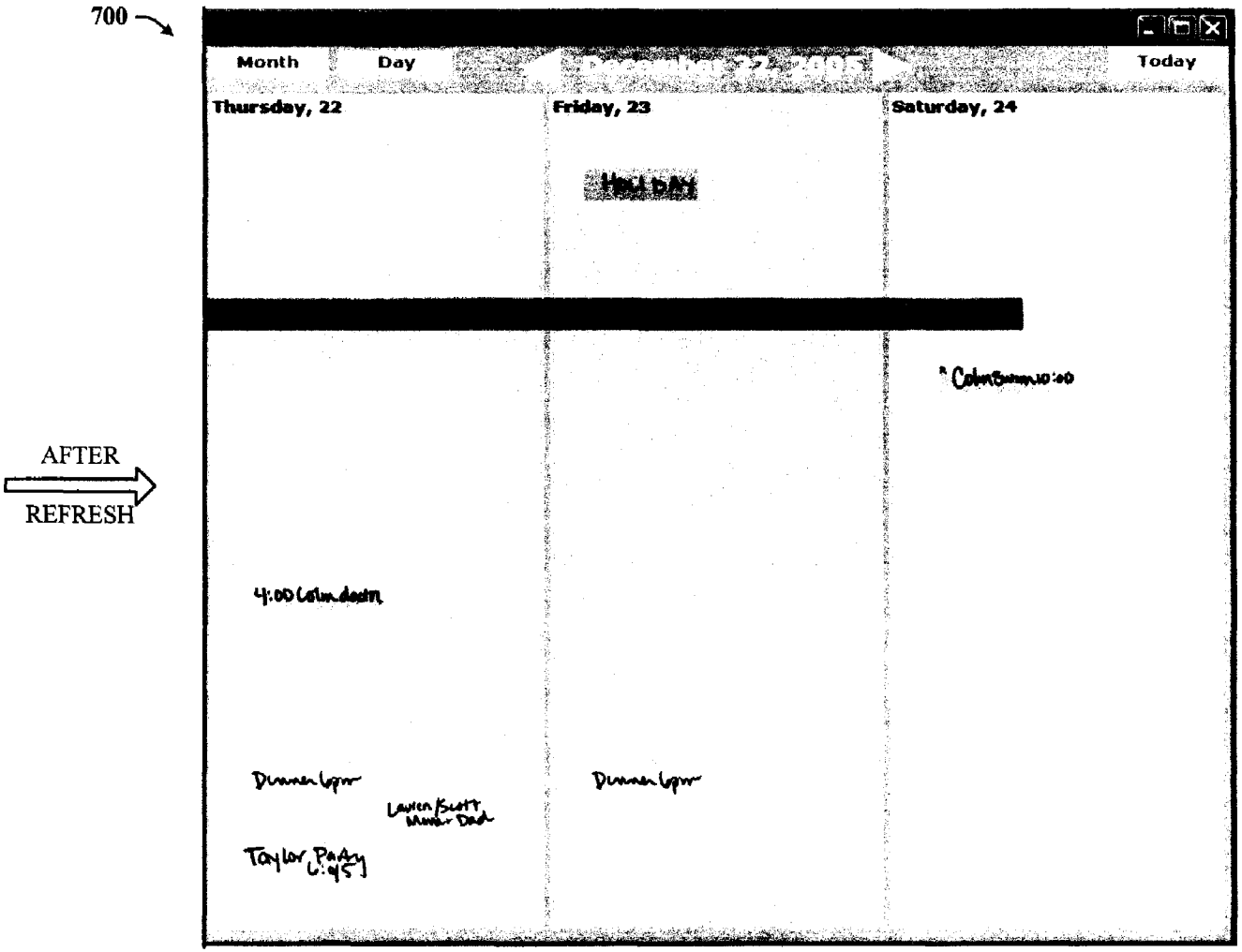
FIG. 7 demonstrates a refresh of the calendar image of FIG. 6 in day view.
Figure 8:
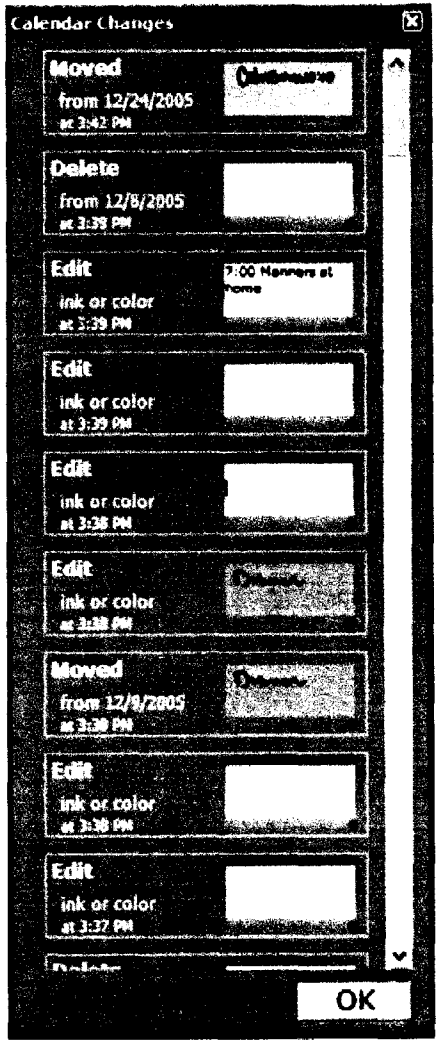
FIG. 8 is an exemplary user interface displaying a change history image which facilitates tracking any changes made to the calendar.

Turning to FIG. 6, there is an exemplary user interface displaying a digital calendar image 600 in day view where items are organized according to time buckets. When in month view, the user can view more detail of any day's events by switching to a day view or by zooming into the month view. FIG. 7 demonstrates a refreshed view 700 of the calendar image of FIG. 6 after a change to a calendar item has been entered (e.g., Colin swim 10:00). To view all or just the recent changes to the calendar, an image of a change history can be retrieved as well. For example, FIG. 8 demonstrates an exemplary change history image to facilitate tracking any changes made to the calendar.

In general, the digital calendar can be primarily maintained on one or more base devices using a digital calendar system. Any information entered into the digital calendar system can be stored, retrieved, and/or synchronized with other devices to mitigate the need to maintain different calendars or different versions of calendars. In particular, the calendar data can be stored internally or externally on a server located in the home, for example, or at a remote location. Thus, essentially one calendar can be kept and updated with ease so that its users can readily manage and coordinate their schedules in a more efficient manner without the need to keep up with multiple calendars.

In practice, for instance, imagine that Mary and John Smith have two teenage boys who are each involved in different sports and clubs in school. John travels for business several times each month and Mary volunteers part time for a few different organizations. The Smith family calendar includes practice and game times for both boys as well as a few meeting times for their clubs, routine dentist appointments for all of them, birthday parties, dinner dates with friends, Mary's volunteer schedule and John's travel dates for the next month or so. Mary gets a call at home from her sister Jane asking if their families can get together for brunch this Sunday. With a quick glance at the digital calendar in month view (e.g., in the kitchen), Mary writes in "brunch with Jane and fam" and drags the item to Sunday. The Smiths also have a home office or den, where John likes to retreat to relax and go through his magazines, bills, and other mail. From the computer in the den, he can check the digital calendar to see if there are any plans for the upcoming weekend. The current digital calendar can be uploaded or updated with any changes made (e.g., via a "sync" operation) so that the calendar viewed in the den is the same version as the one maintained on the local awareness appliance in the kitchen. From the computer in the den, John can also interact with the digital calendar. For example, John can cancel a trip scheduled for next week and add in a new trip for the week after. In the kitchen, Mary can check for any changes to the calendar by an update or sync operation in order to view John's changes.

Furthermore, both Mary and John can view an image of the calendar from each of their mobile devices. Overall, the digital calendar system provides improved coordination among or between multiple users in part by increasing the flexibility of data input and synchronization with multiple devices.

Input for the digital calendar can be received from a variety of input devices such as an inkable pen or stylus, keyboard, mouse, touch pad, and voice (via a voice recognition component/system). However, the inkable format (510) of the digital calendar provides users with additional flexibility and saves time, thus making use of the digital calendar more efficient and practical than conventional alternatives.

Input can be analyzed and characterized as new content or as modifications to existing content. Visualization cues can be employed to make new items more noticeable. For example, they can be viewed in a "new items" list for a period of time from when they were entered. Each new item can also be noted with a symbol so that when a user views the calendar such as in month view, the symbol is shown with the new items for a period of time. Similarly, changed or modified items can be tracked and displayed in a list. By tracking changes including deletions in this manner, modifications to the calendar items can be monitored to mitigate altering or removing an item without another user's knowledge. Essentially, tracking and displaying changes to items controls access to the digital calendar so that users cannot intentionally or unintentionally remove or change the content, dates, or times of events or activities.

As is often the case, some days are more congested with appointments than other days. To accommodate the visibility of items on such days, items can be organized for any particular day in chronological order and/or in a layout that optimizes the visibility of each item so that items are not inadvertently hidden from view. Items can also be re-sized either manually by the user or automatically based on the item's content, time detail, or priority rating. For example, items that include certain words or names such as "dinner" or "Mariners" may be automatically sized smaller than other items to make better or more efficient use of the available space for each day. Artificial intelligence systems can be trained to learn such user behaviors or preferences. In another example, items which are not associated with a specific time (e.g., designated "anytime") may also be made smaller in terms of viewable size than those items set to occur at a specific time. Alternatively or in addition, "heavier" days can be enlarged and less busy days can be shrunken accordingly while still maintaining the spatial integrity of the calendar grid to optimize the overall display space available for the calendar. That is, days with very few or no activities may not be completely obscured by days with many activities.

A variety of customization tools may be available to the user for choosing font or ink color, ink width, note color, and the like. A new event space can be included on the user interface. This space maybe similar to a notepad with an unlimited number of sheets and include lines as a writing guide in the space. When the user is finished with entering the information, the note can be dragged to the desired day on the calendar using one or more control points on the note. When the note is dragged onto the calendar, it may shrink in dimension to a smaller uniform size but remain substantially readable. To enlarge the view of the note, the note can be resized manually at one or more control points or such points can be clicked on for zooming in or out. Dragging off the calendar can cause notes to grow to their full size.

In the month view, the calendar can provide at-a-glance awareness of multiple events per day when they are sized accordingly. However, more events on a day may cause overlap of the notes. Should there be so many events that at least one event appears buried or hidden from view, various visual cues can be employed to make it readily apparent to the user that some events are "off-screen" or otherwise out of view. In addition, the user can hover over open space on the day to see a total number of notes present. Alternatively, the total number can appear in the open space near the day (see e.g., FIG. 5—Oct. 19, 2005, supra). This notation can also be triggered when more than y events are scheduled on any day. To modify any information relating to the item such as the time of day, setting a reminder, or the content of the note, a menu can appear for each item when hovering over the item, for instance.

Although much of the discussion relating to data entry in the calendar relies on direct user input by keying or writing, calendar items can also be added, modified, or deleted by downloading information from external sources such as the Web, email, or information stored on another device that can communicate with the digital calendar system. For example, imagine the user is a Mariners season ticket holder and would like to calendar all of the home games. The user can download or import the schedule from the Mariners' website onto his/her digital calendar.

From the month view of the calendar, the user can quickly switch to a day view (e.g., FIG. 6, supra). In particular, FIG.

6 represents an exemplary digital calendar in "day+2" view where calendar items are organized according to time buckets including any time, morning, afternoon, and evening. Time buckets allow the user to spatially organize events throughout the day. In the "day+2" view, the user can see the desired day as well as two additional days which may be the next two days, the previous 2 days, or the day before and the day after. Alternatively, the user can set the day view to see only one day at a time or day+n, where n is an integer greater than zero. The system may set a maximum value to n.

Various methodologies will now be described via a series of acts. It is to be understood and appreciated that the subject system and/or methodology is not limited by the order of acts, as some acts may, in accordance with the subject application, occur in different orders and/or concurrently with other acts from that shown and described herein. For example, those skilled in the art will understand and appreciate that a methodology could alternatively be represented as a series of interrelated states or events, such as in a state diagram. Moreover, not all illustrated acts may be required to implement a methodology in accordance with the subject application.

Figure 9:
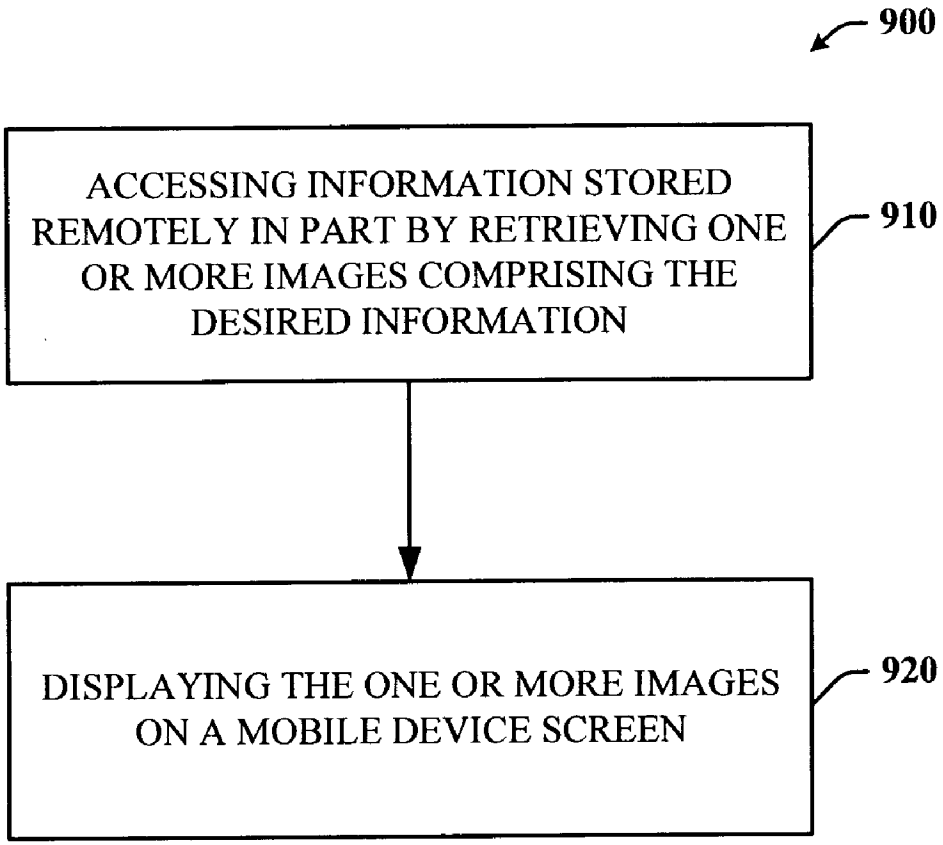
FIG. 9 is a flow chart illustrating an exemplary methodology that facilitates mobile awareness of activities and availability using images of calendar data.

Referring now to FIG. 9, there is a flow diagram of an exemplary method 900 that facilitates mobile awareness of activities and availability using images of calendar data. The method 900 involves accessing information stored remotely in part by retrieving one or more images comprising the desired information at 910. At 920, the one or more images can be displayed on a mobile device screen. Though not shown in the figure, the method 900 can further include refreshing the image to obtain a most current version of the information. In addition, the image can be viewed as originally presented to the user and/or by zooming, panning, and scrolling through the display space to view different portions of the image or more or less details of the image. When desired by the user, new information can also be entered via the mobile device in order to modify the existing information in the image. For example, if the user wishes to add an appointment on her calendar via her smart phone, she can input this data onto the calendar using the keypad of the smart phone.

Figure 10:
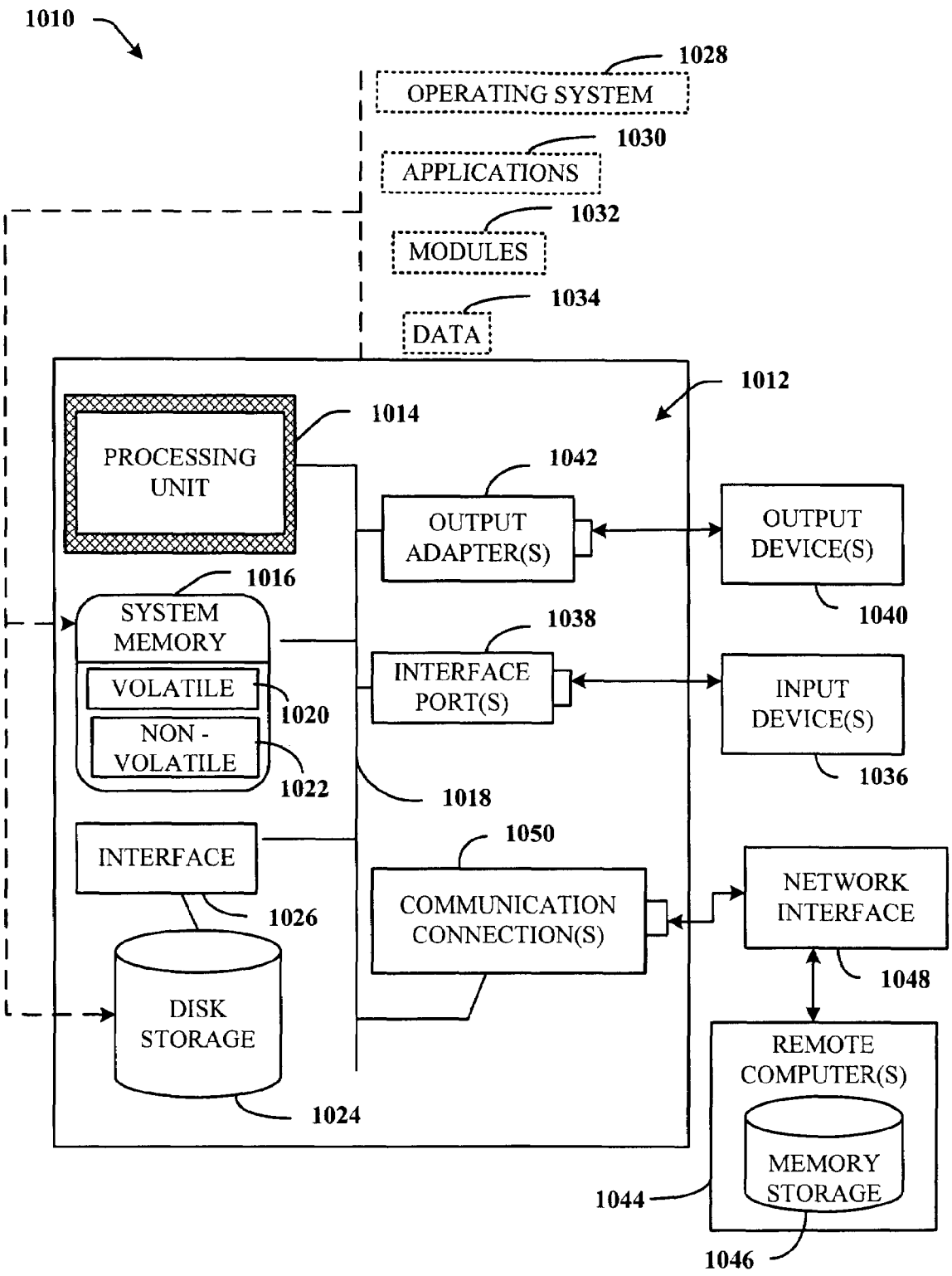
FIG. 10 illustrates an exemplary environment for implementing various aspects of the invention.

In order to provide additional context for various aspects of the subject application, FIG. 10 and the following discussion are intended to provide a brief, general description of a suitable operating environment 1010 in which various aspects of the subject application may be implemented. While the system(s) and/or method(s) is described in the general context of computer-executable instructions, such as program modules, executed by one or more computers or other devices, those skilled in the art will recognize that the invention can also be implemented in combination with other program modules and/or as a combination of hardware and software.

Generally, however, program modules include routines, programs, objects, components, data structures, etc. that perform particular tasks or implement particular data types. The operating environment 1010 is only one example of a suitable operating environment and is not intended to suggest any limitation as to the scope of use or functionality of the system and/or method. Other well known computer systems, environments, and/or configurations that may be suitable for use with the system and/or method include but are not limited to, personal computers, hand-held or laptop devices, multiprocessor systems, microprocessor-based systems, programmable consumer electronics, network PCs, minicomputers, mainframe computers, distributed computing environments that include the above systems or devices, and the like.

With reference to FIG. 10, an exemplary environment 1010 for implementing various aspects of the system and/or method includes a computer 1012. The computer 1012 includes a processing unit 1014, a system memory 1016, and a system bus 1018. The system bus 1018 couples system components including, but not limited to, the system memory 1016 to the processing unit 1014. The processing unit 1014 can be any of various available processors. Dual microprocessors and other multiprocessor architectures also can be employed as the processing unit 1014.

The system bus 1018 can be any of several types of bus structure(s) including the memory bus or memory controller, a peripheral bus or external bus, and/or a local bus using any variety of available bus architectures including, but not limited to, 11-bit bus, Industrial Standard Architecture (ISA), Micro-Channel Architecture (MCA), Extended ISA (EISA), Intelligent Drive Electronics (IDE), VESA Local Bus (VLB), Peripheral Component Interconnect (PCI), Universal Serial Bus (USB), Advanced Graphics Port (AGP), Personal Computer Memory Card International Association bus (PCMCIA), and Small Computer Systems Interface (SCSI).

The system memory 1016 includes volatile memory 1020 and nonvolatile memory 1022. The basic input/output system (BIOS), containing the basic routines to transfer information between elements within the computer 1012, such as during start-up, is stored in nonvolatile memory 1022. By way of illustration, and not limitation, nonvolatile memory 1022 can include read only memory (ROM), programmable ROM (PROM), electrically programmable ROM (EPROM), electrically erasable ROM (EEPROM), or flash memory. Volatile memory 1020 includes random access memory (RAM), which acts as external cache memory. By way of illustration and not limitation, RAM is available in many forms such as synchronous RAM (SRAM), dynamic RAM (DRAM), synchronous DRAM (SDRAM), double data rate SDRAM (DDR SDRAM), enhanced SDRAM (ESDRAM), Synchlink DRAM (SLDRAM), and direct Rambus RAM (DRRAM).

Computer 1012 also includes removable/nonremovable, volatile/nonvolatile computer storage media. FIG. 10 illustrates, for example a disk storage 1024. Disk storage 1024 includes, but is not limited to, devices like a magnetic disk drive, floppy disk drive, tape drive, Jaz drive, Zip drive, LS-100 drive, flash memory card, or memory stick. In addition, disk storage 1024 can include storage media separately or in combination with other storage media including, but not limited to, an optical disk drive such as a compact disk ROM device (CD-ROM), CD recordable drive (CD-R Drive), CD rewritable drive (CD-RW Drive) or a digital versatile disk ROM drive (DVD-ROM). To facilitate connection of the disk storage devices 1024 to the system bus 1018, a removable or non-removable interface is typically used such as interface 1026.

It is to be appreciated that FIG. 10 describes software that acts as an intermediary between users and the basic computer resources described in suitable operating environment 1010. Such software includes an operating system 1028. Operating system 1028, which can be stored on disk storage 1024, acts to control and allocate resources of the computer system 1012. System applications 1030 take advantage of the management of resources by operating system 1028 through program modules 1032 and program data 1034 stored either in system memory 1016 or on disk storage 1024. It is to be appreciated that the subject system and/or method can be implemented with various operating systems or combinations of operating systems.

A user enters commands or information into the computer 1012 through input device(s) 1036. Input devices 1036 include, but are not limited to, a pointing device such as a mouse, trackball, stylus, touch pad, keyboard, microphone, joystick, game pad, satellite dish, scanner, TV tuner card, digital camera, digital video camera, web camera, and the like. These and other input devices connect to the processing unit 1014 through the system bus 1018 via interface port(s) 1038. Interface port(s) 1038 include, for example, a serial port, a parallel port, a game port, and a universal serial bus (USB). Output device(s) 1040 use some of the same type of ports as input device(s) 1036. Thus, for example, a USB port may be used to provide input to computer 1012 and to output information from computer 1012 to an output device 1040. Output adapter 1042 is provided to illustrate that there are some output devices 1040 like monitors, speakers, and printers among other output devices 1040 that require special adapters. The output adapters 1042 include, by way of illustration and not limitation, video and sound cards that provide a means of connection between the output device 1040 and the system bus 1018. It should be noted that other devices and/or systems of devices provide both input and output capabilities such as remote computer(s) 1044.

Computer 1012 can operate in a networked environment using logical connections to one or more remote computers, such as remote computer(s) 1044. The remote computer(s) 1044 can be a personal computer, a server, a router, a network PC, a workstation, a microprocessor based appliance, a peer device or other common network node and the like, and typically includes many or all of the elements described relative to computer 1012. For purposes of brevity, only a memory storage device 1046 is illustrated with remote computer(s) 1044. Remote computer(s) 1044 is logically connected to computer 1012 through a network interface 1048 and then physically connected via communication connection 1050. Network interface 1048 encompasses communication networks such as local-area networks (LAN) and wide-area networks (WAN). LAN technologies include Fiber Distributed Data Interface (FDDI), Copper Distributed Data Interface (CDDI), Ethernet/IEEE 1102.3, Token Ring/IEEE 1102.5 and the like. WAN technologies include, but are not limited to, point-to-point links, circuit switching networks like Integrated Services Digital Networks (ISDN) and variations thereon, packet switching networks, and Digital Subscriber Lines (DSL).

Communication connection(s) 1050 refers to the hardware/software employed to connect the network interface 1048 to the bus 1018. While communication connection 1050 is shown for illustrative clarity inside computer 1012, it can also be external to computer 1012. The hardware/software necessary for connection to the network interface 1048 includes, for exemplary purposes only, internal and external technologies such as, modems including regular telephone grade modems, cable modems and DSL modems, ISDN adapters, and Ethernet cards.

What has been described above includes examples of the subject system and/or method. It is, of course, not possible to describe every conceivable combination of components or methodologies for purposes of describing the subject system and/or method, but one of ordinary skill in the art may recognize that many further combinations and permutations of the subject system and/or method are possible. Accordingly, the subject system and/or method are intended to embrace all such alterations, modifications, and variations that fall within the spirit and scope of the appended claims. Furthermore, to the extent that the term "includes" is used in either the detailed description or the claims, such term is intended to be inclusive in a manner similar to the term "comprising" as "comprising" is interpreted when employed as a transitional word in a claim.

What is claimed is:

1. A system that facilitates mobile access to information using images comprising:

an image store that stores information in the form of images the information comprises a change history whereby an image of the change history is viewable to facilitate maintaining an awareness of any changes made to the information;

an image retrieval component that retrieves one or more desired images, the image retrieval component refreshes the one or more images to obtain a current version of the information; and an image display component that displays one or more images on at least one mobile device screen, thereby providing mobile access to the information.

2. The system of claim 1, the information comprises calendar data.

3. The system of claim 2, the calendar data is maintained, managed, and organized by a digital calendar system.

4. The system of claim 3, the digital calendar system is located on one or more base devices.

5. The system of claim 1 further comprises one or more navigational controls that manipulate a view of the one or more images on the mobile device screen.

6. The system of claim 5, the one or more navigational controls comprise one or more keys on a keypad of a mobile device.

7. The system of claim 5, the one or more navigational controls comprise at least one of a zoom control, pan control, scroll control, and data input control.

8. A user interface on a mobile device that facilitates viewing information using images comprising:

an image display space that is at least one of zoomable, pannable, and scrollable; and an information bar that identifies a current state of the image in the display space, the current state of the image includes age of the image and said image comprises a change history that is viewable to facilitate maintaining an awareness of any changes made to the information.

9. The user interface of claim 8, the current state of the image comprises at least one of the following: view of the image, source of the image, and date range of the image.

10. The user interface of claim 8 further comprises a refresh control that retrieves a most current version of the image.

11. The user interface of claim 8, the image comprises a calendar in at least one of a month view, week view, and day view.

12. The user interface of claim 8 further comprises a data entry field wherein data can be entered to modify contents of the image.

13. The user interface of claim 8 further comprises a plurality of navigational components that correspond to one or more input keys of the mobile device that allow movement through the display space.

14. A method that facilitates mobile awareness and coordination of events comprising:

accessing information stored remotely in part by retrieving one or more images comprising the desired information;

displaying the one or more images on a mobile device screen;

entering new information on the mobile device to change the existing information in the one or more images; and retrieving a change history image which facilitates maintaining an awareness of any changes made to the information.

15. The method of claim 14 further comprises refreshing the image to obtain a most current version of the information.

16. The method of claim 14 further comprises viewing the image by performing at least one of the following: zooming, panning, and scrolling.

17. The method of claim 14 further comprises navigating through the mobile device screen to view one or more perspectives of the one or more images using one or more input keys of the mobile device.

* * * * *